US011892253B1

(12) United States Patent
Tzamarot

(10) Patent No.: US 11,892,253 B1
(45) Date of Patent: Feb. 6, 2024

(54) SAFETY DEVICE TO DISABLE A FIREARM

(71) Applicant: Aaron Tzamarot, Scarsdale, NY (US)

(72) Inventor: Aaron Tzamarot, Scarsdale, NY (US)

( * ) Notice: Subject to any disclaimer, the term of this patent is extended or adjusted under 35 U.S.C. 154(b) by 0 days.

(21) Appl. No.: 17/938,385

(22) Filed: Oct. 6, 2022

(51) Int. Cl.
*F41A 17/06* (2006.01)

(52) U.S. Cl.
CPC ..... *F41A 17/063* (2013.01)

(58) Field of Classification Search
CPC ..... F41H 13/00; F41H 17/063
See application file for complete search history.

(56) References Cited

U.S. PATENT DOCUMENTS 4,196,668 A * 4/1980 Morlock ..... F41H 11/02 102/401
4,682,435 A * 7/1987 Heltzel ..... F41A 17/063 42/70.11
5,675,925 A * 10/1997 Wurger ..... F41A 17/06 42/70.11
6,148,557 A * 11/2000 Lindskog ..... F41A 17/06 42/70.01
6,615,528 B1 * 9/2003 Lindskog ..... F41A 17/44 42/70.01
8,087,551 B2 * 1/2012 Henley, II ..... F41A 13/04 222/386
8,887,638 B1 * 11/2014 Calvert ..... F42B 12/20 102/430
9,222,743 B1 * 12/2015 Shah ..... F41A 17/08
9,523,561 B2 * 12/2016 Di Mauro Lorenzi ... F41H 9/10
9,644,911 B1 * 5/2017 McLean, III ..... F41A 17/063
9,714,803 B2 * 7/2017 Giebel ..... F41A 17/74
11,156,420 B1 * 10/2021 Clark ..... F41C 23/16
11,187,501 B2 * 11/2021 Waswo ..... F42B 5/145
2016/0047616 A1 * 2/2016 Giebel ..... F41A 17/64 42/70.01
2016/0202025 A1 * 7/2016 Di Mauro Lorenzi ..... F41A 17/063 89/1.11

* cited by examiner

*Primary Examiner* — Joshua E Freeman
(74) *Attorney, Agent, or Firm* — Dunlap Bennett & Ludwig, PLLC

(57) ABSTRACT

A safety device for a firearm and system associated therewith are herein disclosed. The safety system includes a communications module, an activation module, a power source, a chamber housing, a substance, and a detonator. The communications module is designed to communicate with a remote device. The activation module that is designed to communicate with the communications module. The power source powers the communications module and the activation module. The substance is contained within the chamber housing. The detonator is at least partially contained within the chamber housing. In use, the detonator operative to compel the substance out of the chamber housing and into a body portion of the firearm when activated by the activation module.

11 Claims, 7 Drawing Sheets

SAFETY DEVICE TO DISABLE A FIREARM

BACKGROUND OF THE INVENTION

The present invention relates to firearms and, more particularly, to a device that is configured to be remotely activated to disable a firearm.

School and other mass shootings have been on the rise for the past two decades. In fact, almost half of school shootings in the United States since 1970 have occurred in the past decade. Innocent lives, in particular, young children, are lost to senseless gun violence on a daily basis.

There is currently no way to effectively disarm an individual who is perpetrating one of these mass shooting events. Too often is the shooter either hidden out of view from law enforcement or uses hostages as a shield. Typically, the only way to stop the shooter is by the hostages overtaking the shooter (which is dangerous and often unsuccessful) or law enforcement engaging the shooter (which usually takes time and is not always successful at immediately disarming the shooter). Further, delayed response times to these events can lead to additional deaths that may otherwise be preventable.

As can be seen, there is a need for a safety device and system as discussed herein.

SUMMARY OF THE INVENTION

In one aspect of the present invention, a safety device configured to be mounted in a firearm is disclosed, with the safety device comprising: a communications module configured to communicate with a remote device; an activation module that communicates with the communications module; a power source for powering the communications module and the activation module; a chamber housing; a substance contained within the chamber housing; and a detonator at least partially contained within the chamber housing, the detonator being operative to compel the substance out of the chamber housing and into a body portion of the firearm when activated by the activation module, in use.

In another aspect of the present invention, a safety system is disclosed that comprises: a firearm; a remote device; and a safety device mounted in the firearm, the safety device comprising: a communications module that communicates with the remote device; an activation module that communicates with the communications module; a power source for powering the communications module and the activation module; a chamber housing; a substance contained within the chamber housing; and a detonator at least partially contained within the chamber housing, the detonator being operative to compel the substance out of the chamber housing and into a body portion of the firearm when activated by the activation module, in use.

The present invention makes use of various technologies, such as remote activation, global positioning system (GPS), and self-charging to enable operation of a single device that improves the safety of every individual. The safety device may be embodied in various sizes to enable fit in firearms of all sizes, large or small. In use, law enforcement can remotely (from a safe distance away) detonate the device to jam and destroy the weapon to prevent domestic, mass shooting attempts, terror attacks, and the like. The GPS (or other appropriate tracking signal) may be enabled to indicate the location of a firearm in action to confirm whether it is being used in an appropriate location, e.g., a shooting range for practice, the woods for hunting, or a location that indicates it is likely being used for illegal purposes, e.g., a school, mall, government building, and other sensitive public area locations.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
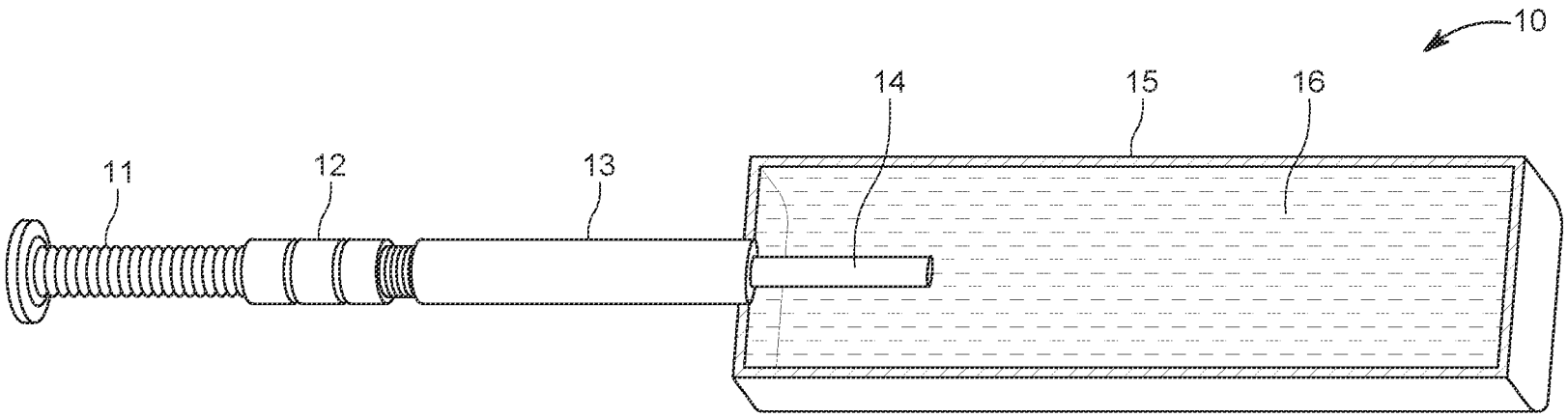
FIG. 1 is a perspective view of a safety device of the present invention, with a portion of a chamber housing cutaway for clarity.
Figure 2:
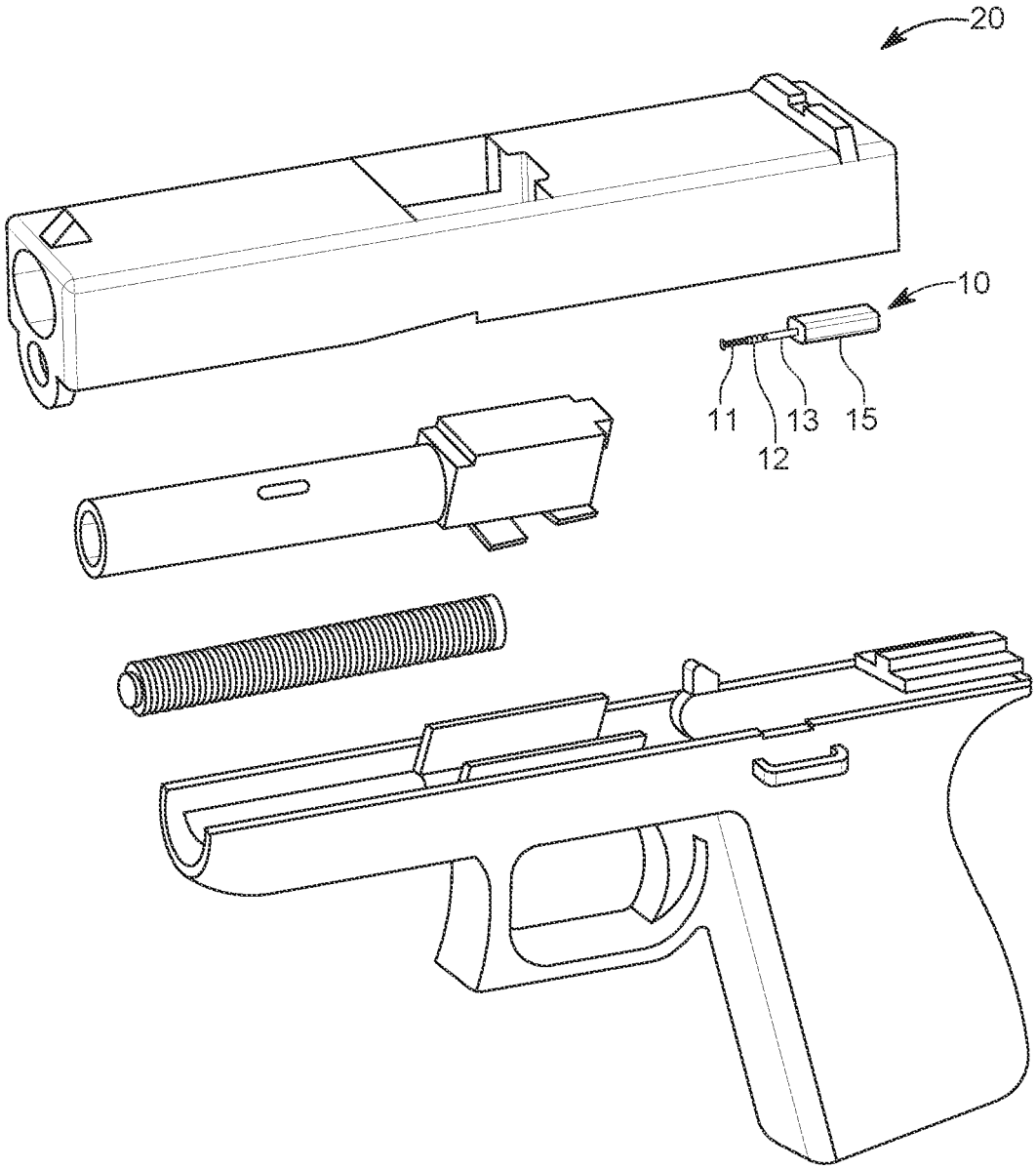
FIG. 2 is an exploded in use view of the safety device, sized and positioned relative to a handgun.
Figure 3:
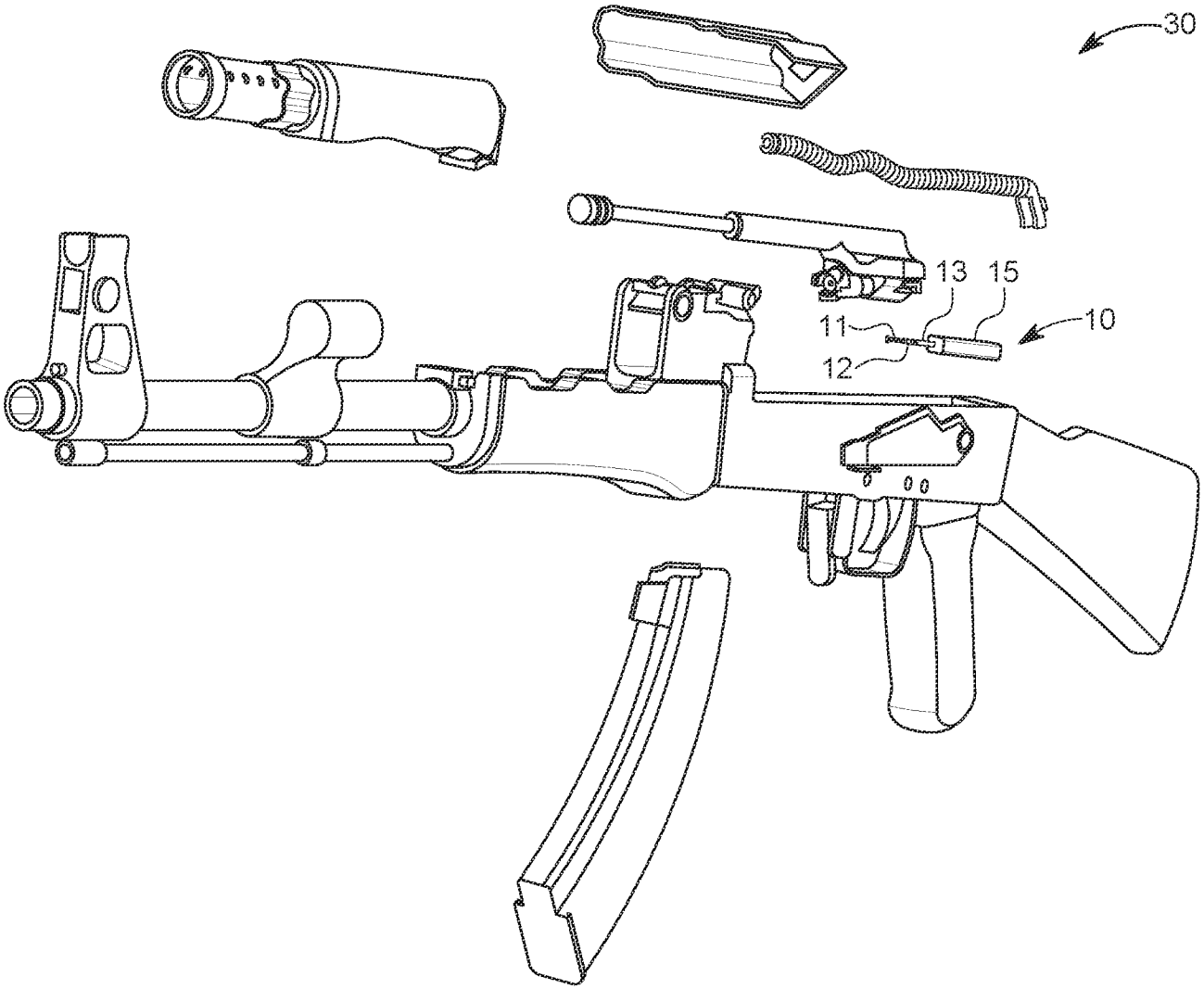
FIG. 3 is an exploded in use view of the safety device, sized and positioned relative to a high-powered rifle.
Figure 4:
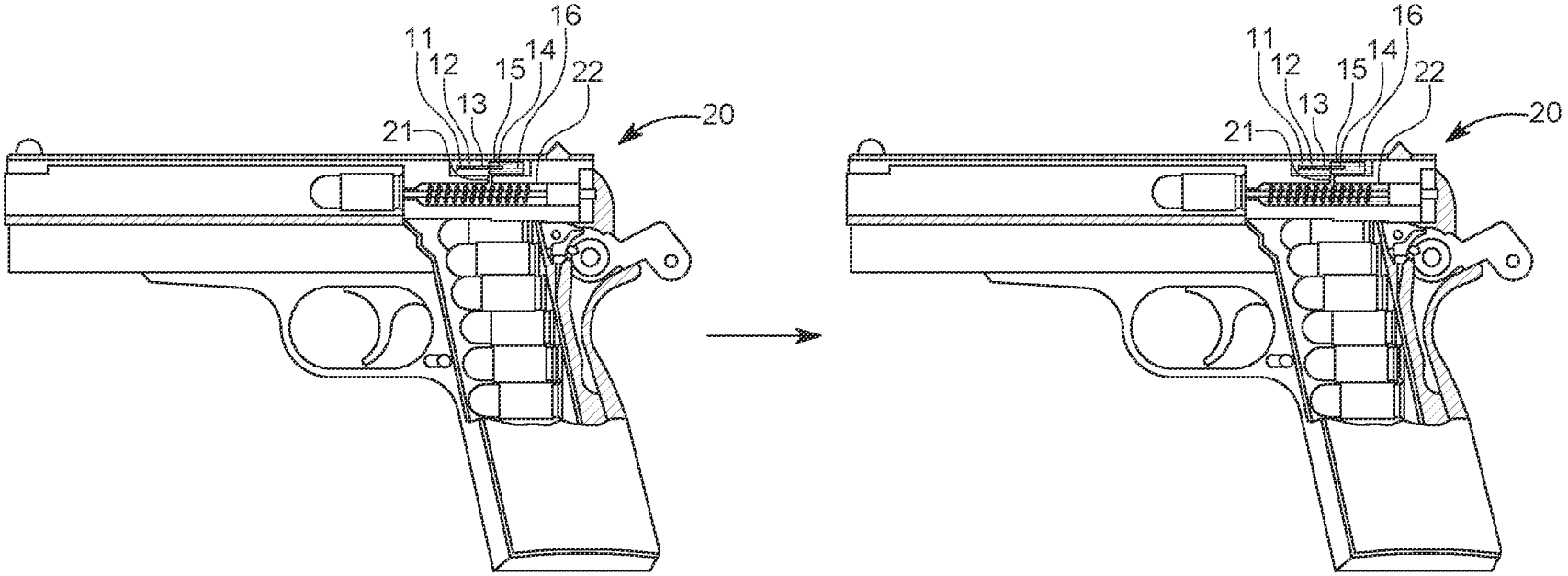
FIG. 4 is a side view of the safety device in use with the handgun, with portions of the handgun cutaway for clarity.
Figure 5:
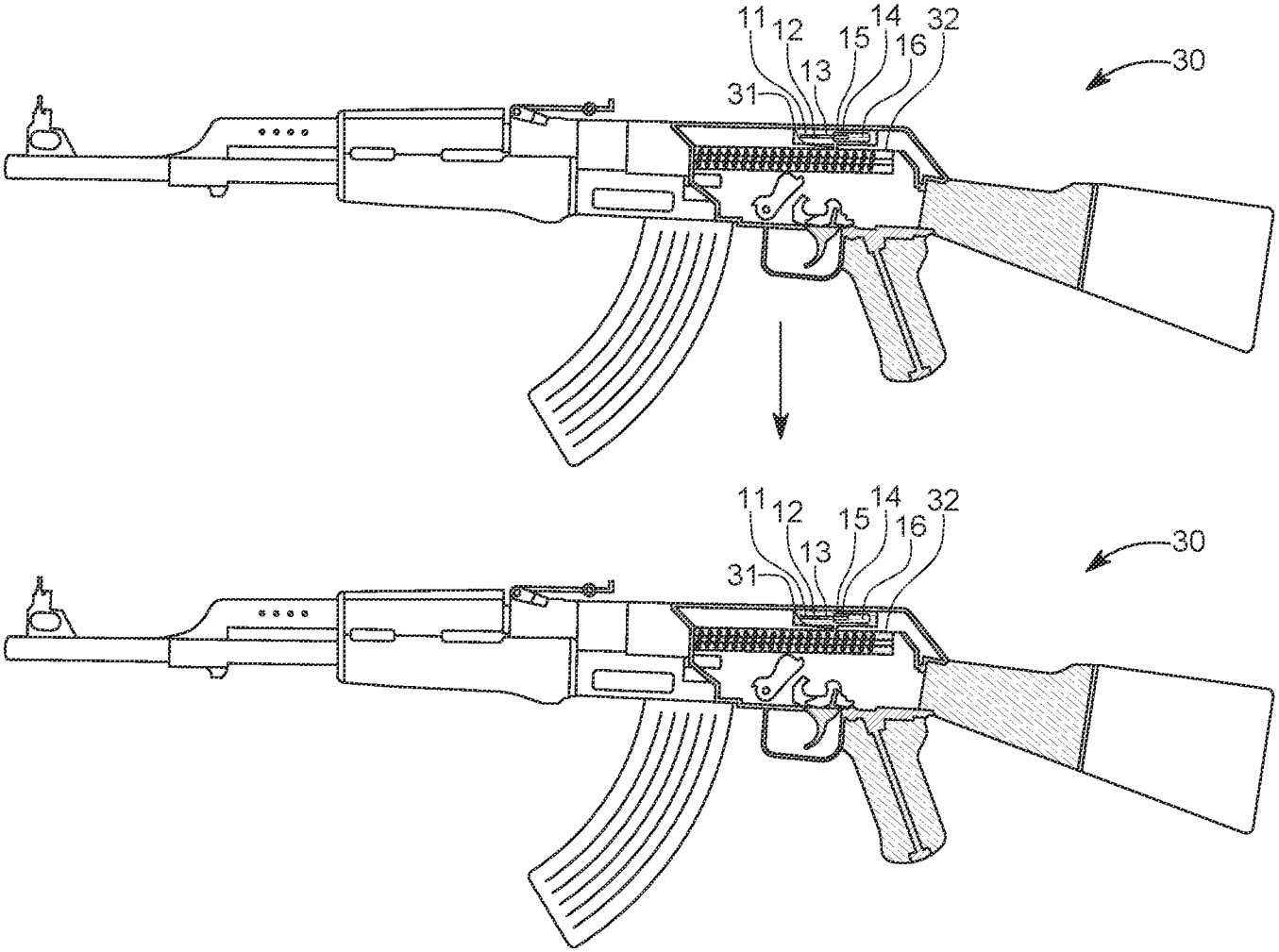
FIG. 5 is a side view of the safety device in use with the high-powered rifle, with portions of the rifle cutaway for clarity.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured.

Broadly, one embodiment of the present invention is a device that is mounted within a firearm and is remotely controlled to disable a firearm (including high-capacity rifles and smaller-size firearms). The device is configured to "self-destruct" within the firearm upon remote activation, thereby disabling it from use. The safety device includes a detonator installed within a container that, when activated, results in a liquified metal entering a body portion of the firearm (e.g., a firing pin chamber) and solidifying to prevent the firearm from being used. Accordingly, law enforcement can prevent an individual from using a firearm for an unlawful purpose. While the primary intent is to prevent mass shootings, those with skill in the art will appreciate that it may have other applications, such as preventing robberies, hostage situations, and the like.

Referring now to FIGS. 1-7, a safety device 10 for firearms is disclosed. The safety device 10 is dimensioned to be insertable into a firearm 20, 30 (e.g., a handgun 20 or rifle 30), as shown in FIGS. 2-5. The safety device 10 can be integrated into any type of firearm, such as, but not limited to, small firearms, pistols, assault, high power, large magazines, and rifles (including automatic and semi-automatic) sold to civilians. The safety device 10 of the present invention may be installed directly at the point of manufacture of the firearm 20, 30. Because it is embedded within the firearm, owners of the firearm do not even need to be aware of the safety device 10, further adding to its effectiveness (if ever in need of deployment). Each safety device 10 may include unique identification information, such as a serial number, that is stored in a database maintained by law enforcement (such as the FBI or state police).

The safety device 10 may include a communication module 11, a power source 12 (e.g., a battery), an activation module 13, a detonator 14, a chamber housing 15, and a metal 16 (or other substance, as discussed herein). These components are all operably coupled together in a manner that enables effective operation when needed. As such, it should be understood that FIGS. 1-5 are not necessarily explicit depictions of how such a safety device 10 should be employed. Rather, they are only intended to relay to those with skill in the art one way in which such a device 10 may be configured. As shown, the communications module 11 and activation module 13 are electrically coupled to the power source 12. The activation module 13 is coupled to the detonator 14, which is housed within the chamber housing 15. Also contained within the chamber housing is the metal 16.

The communications module 11 may be embodied in a number of ways. For example, it may be configured for transmission and reception of a signal over a long-range network (discussed in greater detail with respect to FIG. 6), transmission and reception of a signal over a short-range (discussed in greater detail with respect to FIG. 7), or both long-range and short-range communication. As those with skill in the art will appreciate, the communications module 11 may include a processor and memory for storing and transmitting other identification data regarding the firearm, such as, but not limited to, the aforementioned unique identification information. The processor is designed to implement instructions received, such as to initiate the activation module 13 (explained in greater detail below). A GPS module is also integrated with the communications module 11. Further, the communications module 11 includes a transmitter/receiver for wirelessly transmitting data (including a GPS location) to another location.

The power source 12, as mentioned above, supplies power to the rest of the safety device 10. In certain embodiments, it may be employed as a solar-powered battery. For example, a small solar panel may be integrated with and disguised on an outer portion of the respective firearm 20, 30. Depending on power requirements of the safety device 10, a high-capacity battery may be appropriate for use.

The activation module 13, in certain embodiments, may be a fuse that couples with the detonator 14. The metal 16 is embodied as one with a low melting point. Accordingly, the housing 15 is formed from an insulative material that is heat resistant to prevent damage or malfunction from heat created by moving parts inside the firearm 20, 30 during routine, safe use.

When activated by the processor (or other controller/activation means), the fuse 13 causes the detonator 14 to rapidly heat to a very high temperature sufficient to briefly liquefy the metal 16. Making reference to FIGS. 4 and 5, each version of firearm 20, 30 will include a conduit 21, 31 that connects the housing 15 with the firing pin chamber 22, 32. As shown from left to right in FIG. 4 and top to bottom in FIG. 5, when the detonator 14 liquefies the metal 16, it exits the housing and runs down through the conduit 21, 31 into the firing pin chamber 22, 32. After a brief period of time, the metal 16 cools and solidifies again, thus preventing the firearm 20, 30 from being able to fire. Of course, those with skill in the art will appreciate that other structure may be employed that releases a liquid material (including chemicals) into the firing pin chamber 21, 31 that quickly solidifies to disable the firing pin from operating.

The safety device 10 of the present invention may be selectively activated in at least two ways, which are expounded upon below. As those with skill in the art will appreciate, the method/system utilized may depend on the distance officers are from scene or other event-specific parameters that require consideration.

Figure 6:
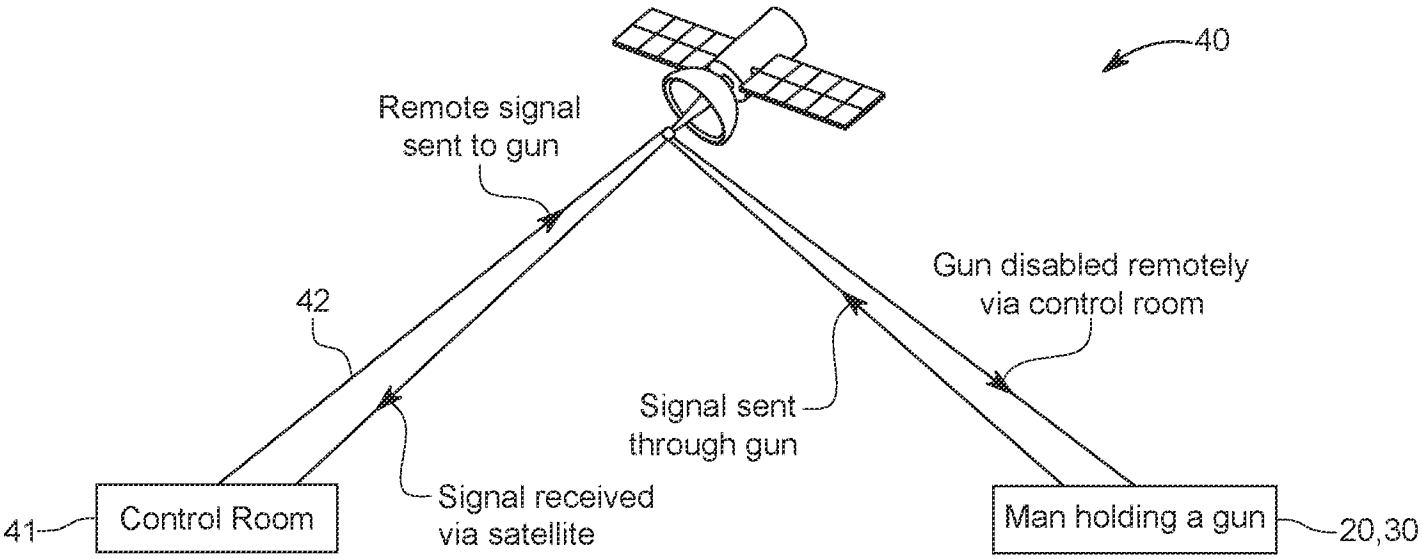
FIG. 6 is a schematic view of a system of the present invention, showing a first method of use.

A first method (a network activation system 40) may be via a signal sent over a network 42 from an individual in a control room 41 (or other remote location). This signal is received by the firearm 20, 30 with integrated safety device (as described with respect to FIGS. 1-5). The network 42 may include, but is not necessarily limited to, a satellite network, as shown in FIG. 6. For example, in certain embodiments, the network may be any communications network capable of transmitting data between computing devices, such as, but not limited to, a Wide Area Network (WAN), a Local Area Network (LAN), Personal Area Network (PAN), wireless networks, the Internet, overlay networks, satellite networks, or any combination thereof. As such, the control room 41 and firearm 20, 30 with integrated safety device 10 could be located anywhere across the globe relative to one another and still be able to communicate, provided there is access to a network 42.

Using this system 40 (network activation), the firearm 20, 30 can be identified (using the identification information) and the location of a firearm 20, 30 can be tracked via the communications module 11 (which may include GPS or other location-detecting devices, as discussed above) in the safety device 10. Thus, the likely identity of the individual in possession of the firearm 20, 30 can be determined, and their movements can be tracked as they move with the firearm 20, 30. In the control room 41, the firearm 20, 30 can be remotely disabled with a single press of a button of a remote device (e.g., on a computer or on an application running on a mobile device). The signal sent is received by the communications module 11 in the specifically selected firearm 20, 30 and processed to cause the detonator 14 to liquefy the solid metal 16 in a manner as previously described.

Figure 7:
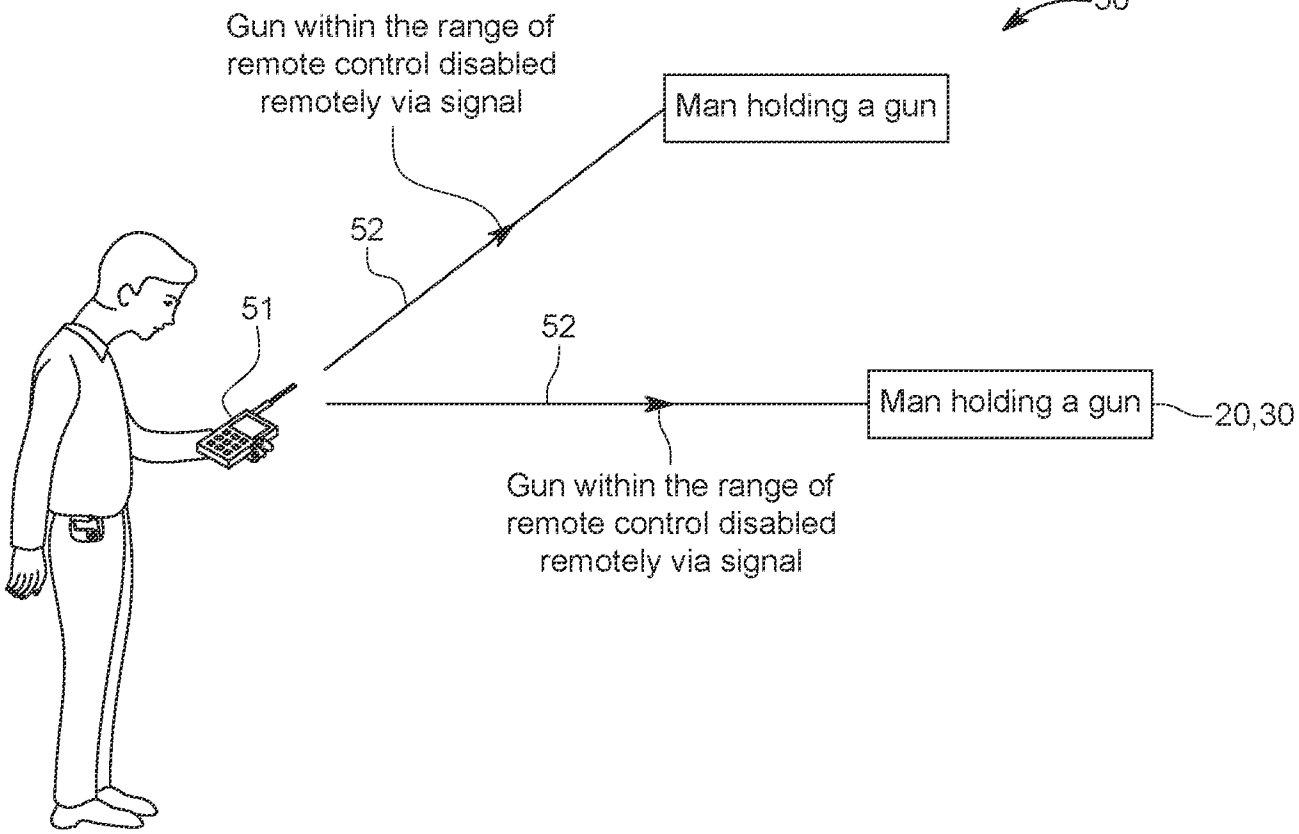
FIG. 7 is a schematic view of a system of the present invention, showing a second method of use.

As shown in FIG. 7, a second method (a remote control activation system 50) the device may be activated is via a signal 52 sent via a remote control 51 (i.e., a remote device) operated by a law enforcement individual at the general location the firearm 20, 30 is being used. The remote control may employ one of various short-range wireless communication techniques to activate the safety device, such as but not limited to, infrared light or UHF radio waves in ISM bands (i.e., BLUETOOTH™). In certain embodiments, the remote control 51 is configured in such a way that the operator simply points it in the direction of the firearm 20, 30 and presses a button to send a "detonate" signal 52, causing the detonator 14 to activate, as previously discussed. While this method requires an operator (e.g., a law enforcement officer) to be on-site at the location of the shooting (while distanced from the shooter at a safe location), it is relatively less complex than the first method. Further, it may be useful in instances where a network connection 42 is not available. As shown in FIG. 7, the remote control 51 is capable of disabling multiple firearms 20, 30 that have the integrated safety device 10.

While the present invention is primarily intended for use to disarm a shooter at a mass shooting event, it should be understood that the present invention has many different potential uses. For example, the safety device 10 could be used as a backup security and safety system to jam or disable any type of equipment or moving parts systems that might get out of control. Other types of activation equipment do not need to necessarily be located remotely or high tech. The activation equipment could simply be a specific, individual "remote control" option that is designed and customized to specific equipment safety for daily emergency use. Further, the safety device 10 can be sized based on where and how it is being used.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

The present disclosure envisions any suitable number of computing systems to implement the above-discussed network activation system 50. It also contemplates the computing system taking any appropriate physical form. In exemplary embodiments, computing system may be a desktop computer system, an embedded computer system, a laptop computer system, a mobile telephone (e.g., a smartphone), a PDA, a mainframe, a server, a tablet computing device, or combinations thereof. Where appropriate, the computing system may include one or more computing systems; be unified or distributed; be provided in multiple locations; be provided across a plurality of machines; be provided across a plurality of data centers; or reside in a cloud (which may include at least one cloud component in at least one network). Where appropriate, one or more computing systems may perform without substantial temporal or spatial limitation at least one step of one or more methods/processes detailed herein.

In certain embodiments, the computing system includes a processor, memory, storage, an input/output (I/O) interface, a communication interface, and a bus. The present disclosure contemplates any suitable computer system having any suitable number of any suitable components in any suitable arrangement. In certain embodiments, processor includes hardware for executing instructions, such as those that define a computer program, and the present disclosure envisions use of any processor suitable to perform the functions discussed. In certain embodiments, memory includes main memory for storing processor instructions for execution or data for processor to operate on, and the present disclosure envisions any suitable memory. In certain embodiments, storage includes mass storage for data or instructions, and the present disclosure envisions any suitable storage. In certain embodiments, I/O interface includes software, hardware, or both, providing one or more interfaces for communication between computing system 200 and one or more I/O devices. Computing system may include one or more of these I/O devices, where appropriate. One or more of these I/O devices may facilitate communication between a computing system and a user. The present disclosure envisions any suitable I/O interface. In certain embodiments, communication interface includes software, hardware, or both providing one or more interfaces for communication between computing system and one or more other computing systems or one or more networks. The present disclosure envisions any appropriate network and any appropriate communication interface for it. In certain embodiments, bus includes software, hardware, or both coupling components of computing system to each other, and this disclosure contemplates any appropriate bus (or other form of interconnection).

What is claimed is:

1. A safety device configured to be mounted in a firearm, the safety device comprising:
- a communications module configured to communicate with a remote device;
- an activation module that communicates with the communications module;
- a power source for powering the communications module and the activation module;
- a chamber housing;
- a substance contained within the chamber housing; and
- a detonator at least partially contained within the chamber housing, the detonator being operative to compel the substance out of the chamber housing and into a body portion of the firearm when activated by the activation module, in use.

2. The safety device of claim 1, wherein the substance is a metal, and the detonator is operative to melt the metal to compel the metal out of the chamber housing and into the body portion of the firearm when activated by the activation module, in use.

3. The safety device of claim 1, wherein the power source is a solar-powered battery.

4. The safety device of claim 1, wherein the communications module comprises a global positioning system module.

5. A safety system comprising:
- a firearm;
- a remote device; and
- a safety device mounted in the firearm, the safety device comprising:
  - a communications module that communicates with the remote device;
  - an activation module that communicates with the communications module;
  - a power source for powering the communications module and the activation module;
  - a chamber housing;
  - a substance contained within the chamber housing; and
  - a detonator at least partially contained within the chamber housing, the detonator being operative to compel the substance out of the chamber housing and into a body portion of the firearm when activated by the activation module, in use.

6. The safety system of claim 5, wherein the remote device is a remote control.

7. The safety system of claim 6, wherein the remote control transmits a signal to the communications module via short-range communications.

8. The safety system of claim 5, wherein the remote device is a computing device disposed in a control room.

9. The safety system of claim 8, wherein the computing device and the communications module communicate over a network.

10. The safety system of claim 9, wherein the communications module comprises a global positioning system module.

11. The safety system of claim 5, wherein the substance is a metal, and the detonator is operative to melt the metal to compel the metal out of the chamber housing and into the body portion of the firearm when activated by the activation module, in use.

* * * * *